US009687853B2

(12) United States Patent
Nordell

(10) Patent No.: US 9,687,853 B2
(45) Date of Patent: Jun. 27, 2017

(54) CONJUGATE ANVIL HAMMER MILL

(71) Applicant: Lawrence K Nordell, Bellingham, WA (US)

(72) Inventor: Lawrence K Nordell, Bellingham, WA (US)

( * ) Notice: Subject to any disclaimer, the term of this patent is extended or adjusted under 35 U.S.C. 154(b) by 135 days.

(21) Appl. No.: 14/621,181

(22) Filed: Feb. 12, 2015

(65) Prior Publication Data

US 2015/0209795 A1 Jul. 30, 2015

Related U.S. Application Data

(63) Continuation of application No. 13/421,257, filed on Mar. 15, 2012, now Pat. No. 8,955,778.

(60) Provisional application No. 61/452,996, filed on Mar. 15, 2011.

(51) Int. Cl.
*B02C 15/00* (2006.01)
*B02C 15/06* (2006.01)

(52) U.S. Cl.
CPC ..... *B02C 15/06* (2013.01); *B02C 15/003* (2013.01); *B02C 15/004* (2013.01)

(58) Field of Classification Search
CPC ..... B02C 15/06; B02C 15/003; B02C 15/04; B02C 15/004; B02C 15/045
USPC ..... 241/189.1, 228
See application file for complete search history.

(56) References Cited

U.S. PATENT DOCUMENTS 244,316 A * 7/1881 Sample ..... B02B 3/08 241/183
303,125 A * 8/1884 Corcoean ..... B02C 15/16 241/228
438,633 A * 10/1890 Marshall ..... B02C 15/16 241/228
760,010 A * 5/1904 Montgomery ..... B02C 17/1855 241/182
1,092,185 A 4/1914 Sturtevant
1,607,404 A * 11/1926 Low ..... B01F 7/042 241/111
2,045,687 A 3/1931 Armstrong
2,875,955 A * 3/1959 Wendshuh ..... D21B 1/063 241/228
3,061,205 A * 10/1962 Lavallee ..... B03C 1/14 209/38
3,204,878 A 9/1965 Peacock
3,610,542 A * 10/1971 Yamagishi ..... B02C 13/08 241/33

(Continued)

*Primary Examiner* — Faye Francis
(74) *Attorney, Agent, or Firm* — Schacht Law Office, Inc.; Dwayne Rogge

(57) ABSTRACT

A crushing mill with an internal ring inside an external ring is disclosed. In some embodiments, the inner ring has protrusions that fit within pockets in the outer ring such that as the rings rotate rock or other materials may be crushed between the protrusions and pockets of the inner and outer rings, respectively. In some embodiments, the inner and outer rings each have surface protrusions such that rock or other materials may be crushed between the inner and outer rings as they rotate. In some embodiments, the inner ring has a circumferential ridge that fits within a circumferential groove of the outer ring such that rock or other materials may be crushed between the rings. In some embodiments the rings operate at differential speeds with respect to each other to induce shear forces on the material to be crushed.

20 Claims, 16 Drawing Sheets

(56) References Cited

U.S. PATENT DOCUMENTS

| | | | | | |
|---|---|---|---|---|---|
| 4,009,634 | A | | 3/1977 | Barmore | |
| 4,265,408 | A | * | 5/1981 | Voelskow | B02C 17/002 241/167 |
| 4,448,357 | A | | 5/1984 | Harlow et al. | |
| 4,919,344 | A | | 4/1990 | McKie | |
| 5,845,855 | A | * | 12/1998 | Yamada | B02C 2/10 241/260 |
| 6,630,277 | B2 | * | 10/2003 | Naka | B02C 2/10 241/24.18 |
| 8,955,778 | B2 | * | 2/2015 | Nordell | B02C 15/06 241/228 |

* cited by examiner

Fig. 9
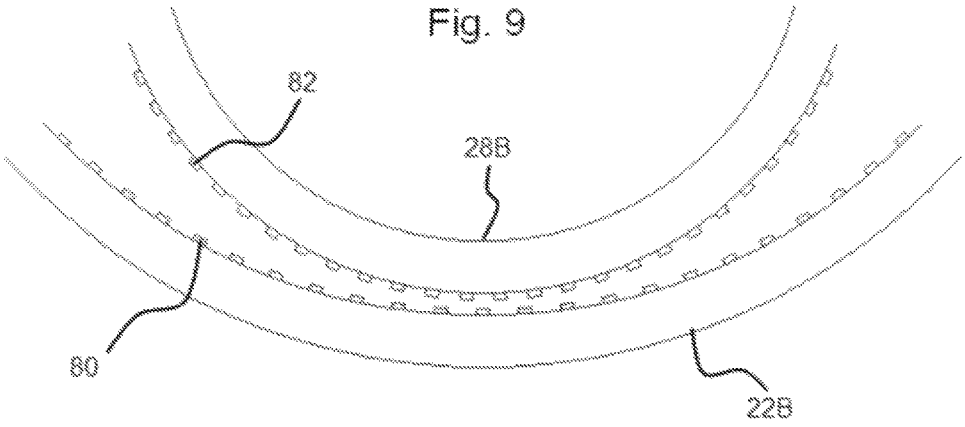
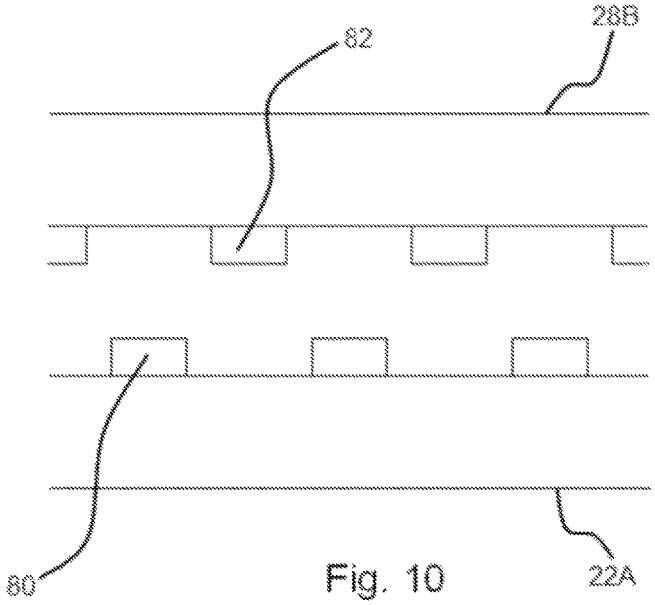
Fig. 10

Fig. 11
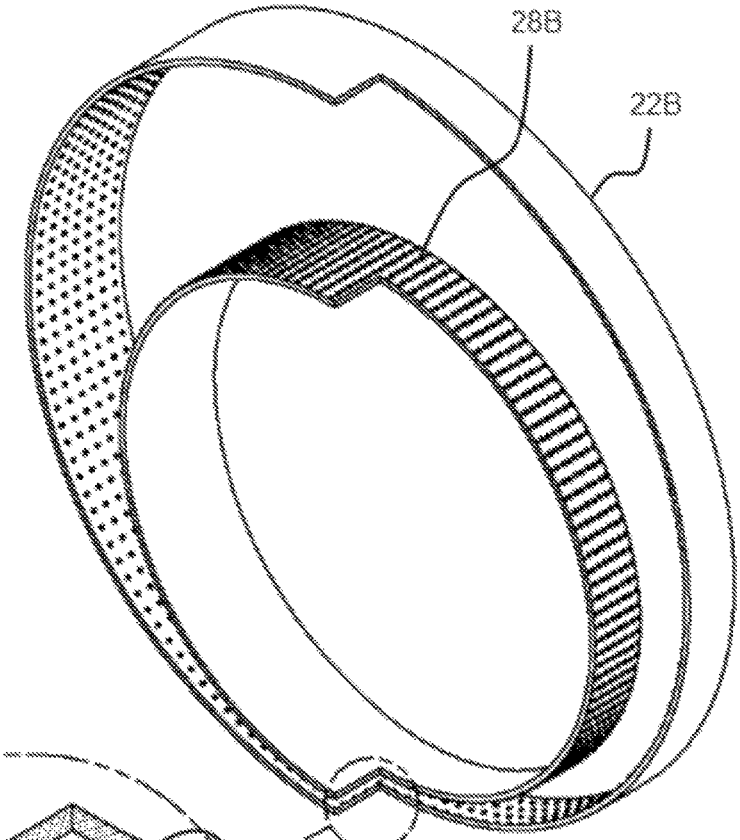
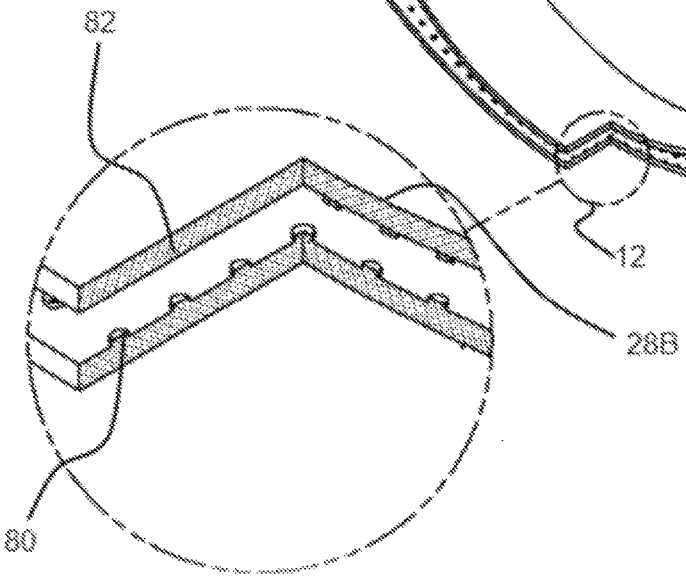
Fig. 12

CONJUGATE ANVIL HAMMER MILL

RELATED APPLICATIONS

This application claims priority benefit of U.S. application Ser. No. 13/421,257 filed on Mar. 15, 2012. U.S. application Ser. No. 13/421,257 claims priority benefit of U.S. Ser. No. 61/452,996, filed Mar. 15, 2011. Each of these applications are incorporated herein by reference.

BACKGROUND OF THE DISCLOSURE a) Field of the Disclosure

This disclosure relates to rock (material) grinding mills and more particularly to a conjugate anvil-hammer mill (CAHM) having a conjugate rotating outer ring housing and rotating inner ring, where the inner ring and outer ring surface interfaces cooperate, and where the respective inner ring outer diameter surface and outer ring inner diameter surface are synchronized to comminute material fed between the rings.

b) Background Art

For many industrial purposes it is necessary to reduce the size of rather large rocks to a much smaller particle size (commonly called "comminution"). For example, the larger rocks may be blasted out of an area such as a hillside, pit or mine, and these larger rocks (sometimes the size of boulders) are then directed into a large rock crusher, which is typically the first stage of comminution after blasting. The blasted rock sizes can exceed 1000 mm (>40 inches) in size. The resulting output of the crusher is typically smaller rock that is less than 200 mm (8 inches) in a longest dimension which is then fed to a grinding mill. The grinding mill typically comminutes the crushed rock down to 50 mm (>2 inches) sized rocks or less.

One common grinding mill comprises a large cylindrical grinding section, rotating along its horizontal axis, which often could have a diameter of as much as ten to fifty feet. One such mill is described in U.S. Pat. No. 7,497,395 incorporated herein by reference. The material (rocks), along with water or air, are directed into one end of the continuously rotating grinding section, which comprises various types of lifting ribs positioned axially on the inside surface of the grinding section to carry the rocks upwardly, on its surface, in a curved upwardly directed path within the grinding chamber so that these partially ground rocks tumble back onto other rocks in the lower part of the chamber. Thus, these rocks impact each other, and the inner surface of the grinding mill, and are broken up into smaller rock fragments. Also, sometimes large iron balls (e.g., two to six inches in diameter) are placed in the grinding chamber to obtain improved results.

It takes a tremendous amount of power to operate these grinding mills, and also there are other substantial costs involved. There are a number of factors which relate to the effectiveness and the economy of the operation, and the embodiments of the disclosure are directed toward improvements in such mills and the methods employed.

SUMMARY OF THE DISCLOSURE

Disclosed herein are several embodiments of a conjugate anvil-hammer mill. The mill comprises an outer ring, or shell having a substantially cylindrical structure. The structure supported on bearing pads or rollers beneath the shell. The shell rotates about its horizontal axis. The shell defines a chamber where rocks are fed into for comminution. The outer ring in one form has a plurality of (anvil) pockets, attached to its inner surface. The conjugate anvil-hammer mill in one form also has an inner ring located within the outer ring, the inner ring comprising a substantially cylindrical structure. The cylindrical structure may be mounted to a horizontally oriented shaft to rotate about a longitudinal center axis which is offset a distance but parallel to the longitudinal center axis of the outer shell. The inner ring including a plurality of protruding (hammer) elements attached to an outer surface of the inner ring, the plurality of protruding hammer elements configured to each engage one of the plurality of anvil pockets of the outer ring as the inner ring and outer ring rotate in surface unison, wherein material may be inserted into the chamber and crushed between the inner ring and the outer ring with a linear rate of compression. The anvil shell may have slotted openings at the bottom of each pocket to allow sized (crushed) rock to be flushed out of the machine during the anvil-hammer rotation. Since the anvil-hammer centers are offset, their rotation causes a closing action of their surface distances to a minimum gap, at 6 o'clock orientation, where the highest compression stress is applied to the rock. The anvil pocket and hammer protrusion create a surface texture that grabs and captures the rock during their concurrent rotating motion, forcing the rock into a smaller and smaller available gap, as the hammer pushes into the anvil pocket, resulting in slow-steady compression fracture of the captured rocks residing within the anvil pocket.

In some embodiments, the inner ring has protrusions that fit within pockets in the outer ring such that, as the rings rotate in synchronous surface motion, rock or other materials may be crushed between the protrusions and/or pockets of the inner and outer rings, respectively. The surface texture and function of the inner and outer rings may be reversed as certain advantages are realized where the outer anvil ring becomes the protruding hammer, and the inner hammer ring becomes the anvil pocket. Tunnels or ports may be installed between the pocket walls to equalize rock volumes between pockets.

In some embodiments, the inner and outer rings each have surface protrusions, such that rock or other materials may be captured between protrusions and then crushed between the inner and outer rings as they rotate, but their surface outer paths do not cross. In this embodiment, the two rings may be operated at different surface speeds to induce a compression and shearing comminution action. In some embodiments, the inner ring has a circumferential annular ridge that fits within a circumferential annular groove of the outer ring such that rock or other materials may be crushed between the rings, due to the offset centers of the rings. In this way, the rings may operate at differential speeds with respect to each other to induce shear forces, as well as compression action on the material to be crushed. In this later embodiment, the circumferential ridges may have transverse ridges to restrain the rock within shallow annular pockets to capture the rock between the dual ridges that allows a compressive and shear comminution action to be applied to the rock captured between ridges when the inner and outer rings are forced to rotate out of unison. In this later embodiment, ports or tunnels may be applied transverse to the annular rings, at the base of the grooves, to equalize the rock volumes between the annular ridges during the compression cycle.

BRIEF DESCRIPTION OF THE DRAWINGS

FIG. 9 is a cross-sectional detail view of an embodiment of an anvil ring and hammer ring with surface mounted pins and no pockets.

FIG. 10 is a detail view of the embodiment of FIG. 9.

FIG. 11 is a perspective view of an embodiment of an anvil ring and hammer ring with surface mounted pins and no pockets.

FIG. 12 is a detail view of the region 12 of FIG. 11.

DESCRIPTION OF THE PREFERRED EMBODIMENTS

Figure 2:
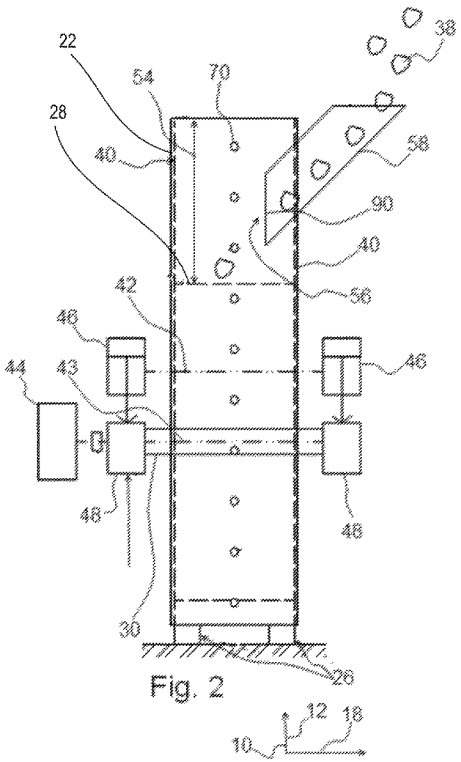
FIG. 2 is a cross-sectional side view of the embodiment of FIG. 1.

In the following disclosure, various aspects of a conjugate anvil-hammer mill (CAHM) will be described. Specific details will be set forth in order to provide a thorough understanding of the disclosure. In some instances, well-known features may be omitted or simplified in order not to obscure the disclosed features. Repeated usage of the phrase "in one embodiment" does not necessarily refer to the same embodiment, although it may.

An axes system 10 is shown and generally comprises a vertical axis 12, an anvil radial axis 14 extending radially outward from the center of the anvil ring 22, a hammer radial axis 16 extending radially outward from the center of the hammer ring 28, and a lateral axis 18. The lateral axis 18 is generally aligned with the axes of rotation of the anvil ring 22, and the hammer ring 28. These axes and directions are included to ease in description of the disclosure, and are not intended to limit the disclosure to any particular orientation.

Where possible, a reference system is use comprising a numeric identifier and an alphabetic suffix. The numeric identifier points out a general element and modifications of that utilize an alphabetic suffix. For example, the general anvil ring is identified in FIG. 1 as 22, while one specific embodiment is shown as 22A in FIG. 3.

To ensure clarity, rock herein is defined as mineral matter of variable composition, consolidated or unconsolidated, assembled in masses or considerable quantities, as by the action of heat or water. Rock may be unconsolidated, such as a sand, clay, or mud, or consolidated, such as granite, limestone, or coal. While not normally defined as rock, equivalent materials such as hardened concrete may also be used in the disclosed mill.

Figure 1:
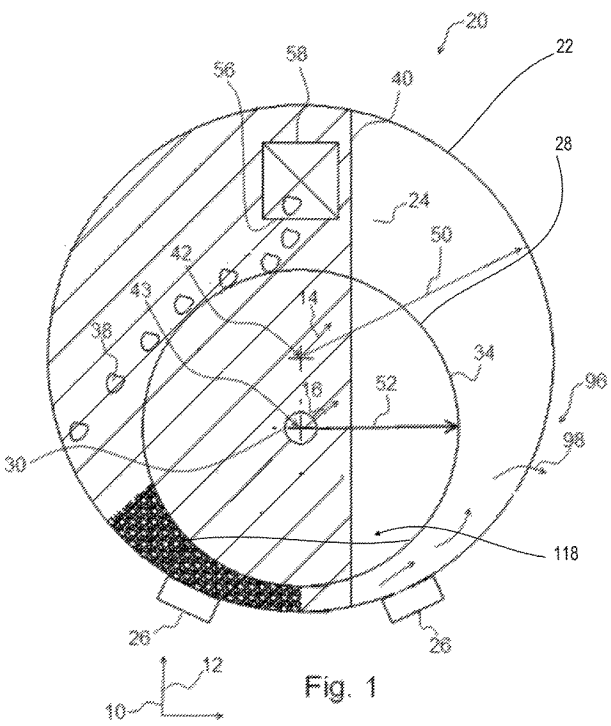
FIG. 1 is a cross-sectional, end view, of one embodiment of the disclosure.

FIG. 1 is a cross-sectional and end view of an embodiment of a CAHM 20 with conjugate converging rings. This embodiment of the CAHM comprises an outer anvil ring 22 having a substantially cylindrical structure which defines a chamber 24 and which is supported in one form by an outer shell supported by bearing pads 26 which may include bearings, lubricants, and/or friction resisting materials. The outer anvil ring 22 rotates about a first longitudinal center axis 42. The outer anvil ring 22 in this form having a plurality of pockets (not shown in FIG. 1, but shown in later figures), and an inner hammer ring 28 located within the outer anvil ring 22, the inner hammer ring 28 in one form comprising a substantially cylindrical structure which in one form is mounted to a driving axial shaft 30 to rotate about a longitudinal axis which is parallel to and offset from the axis of the outer anvil ring, the inner hammer ring 28 in several embodiments having a plurality of protruding elements such as the protruding elements 32A of FIG. 3 attached to an outer surface 34 of the inner hammer ring 28, the protruding elements in this form configured to each engage one of the pockets of the outer anvil ring 22 as the inner hammer ring 28 and outer anvil ring 22 rotate. Material 38 may be inserted into the chamber 24 and crushed between the outer surface 34 of the inner hammer ring 28 and the inner surface of the outer anvil ring 22 with a linear rate of compression. In some embodiments, retaining shields 40 are positioned at the anvil ring outer edges to contain material before and during comminution.

In FIGS. 1 and 2, an embodiment of the hammer ring 28 is shown positioned inside the anvil ring 22, and the rotational axes 43/42 of each ring are shown. In this embodiment, the hammer ring 28 may be powered by a motor 44 and the anvil ring may rest on external bearings (pads 26). In one form, the outer anvil ring 22 is supported by hydrodynamic bearing pads 26 exerting lifting/supporting force on the outer surface 66 of the outer anvil ring 22. While an embodiment is shown where the motor 44 drives the axle of the hammer ring, the motor may alternatively drive the anvil ring by way of a gearing system on the outer surface thereof, or other means such as a belt or chain drive. In some embodiments, the hammer ring 28 may be pressed down by additional force, such as by hydraulic cylinders 46 exerting vertically downward force on the shaft 30, or bearings 48 of the hammer ring 28. By utilizing the weight of one of the hammer ring 28 to crush material 38, power consumption directed toward forcing the rings together can be decreased relative to prior art embodiments. The hammer ring 28 may contain water 118 or other fluids or materials for added weight. This configuration benefits as a constant-pressure, rather than constant gap machine. In this configuration, if material too hard to crush enters the device, the gap between the rings will increase, rather than jamming or damaging the apparatus.

In some embodiments, the inner hammer ring 28 has an outer diameter 52 sized between 50% and 80% of the outer anvil ring 22 inner diameter 50. Another ratio between outer diameter 52 of inner ring and inner diameter of outer ring may be between 0.65 and 0.7. This ratio represents a trade off between (a) a larger inner hammer ring 28 to improve the mechanical crushing advantage and longer wear life of the anvil pocket 36 to crush material, and (b) a smaller inner anvil ring 22 can comminute lighter throughput and be able to crush larger rocks due to the clearance 54 between the rings at the feeding point 56 as shown in the top of FIG. 2.

Operation of one embodiment of the CAHM 20 will now be explained. Rock to be crushed is fed into the mill from a chute 58 that guides the material (rock) 38 into the chamber 24 between the outer anvil ring 22 and inner hammer ring 28. Rotation of the anvil ring 22 with the hammer ring 28 conveys the rock 38, by rotation and gravity, into the anvil pockets 36 which then capture the rock 38, as the protruding element 32 applies steadily increasing pressure comminuting the rock 38 within the pocket 36 by way of compression fracture of the material (rock). In this embodiment, the broken rock 38 then passes through the anvil exit grate 60 at the bottom of each pocket 36 or is held therein at which point the crushed rock may clear the retaining shield 40, or may be recycled after breakage for further comminution by the rotating action of the anvil ring 22 and hammer ring 28 in a following pass.

Figure 5:
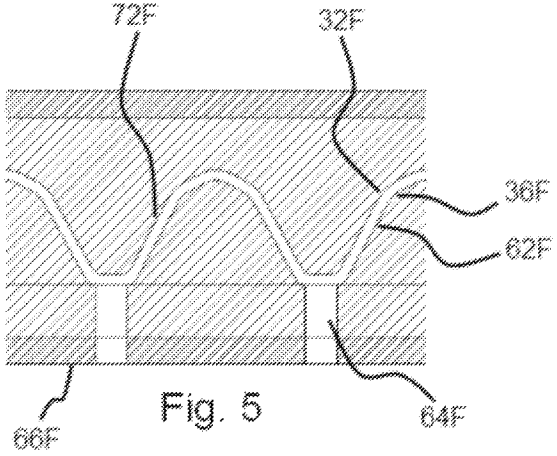
FIG. 5 is a detail view of the embodiment of FIG. 3.
Figure 6:
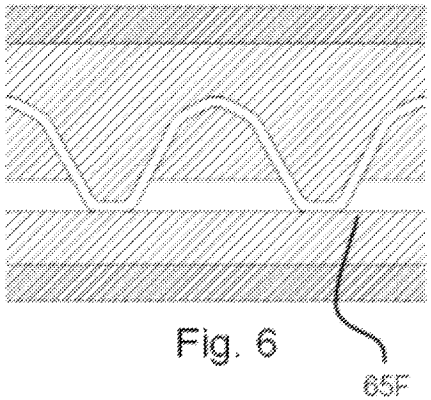
FIG. 6 is a detail view of the embodiment of FIG. 4
Figure 13:
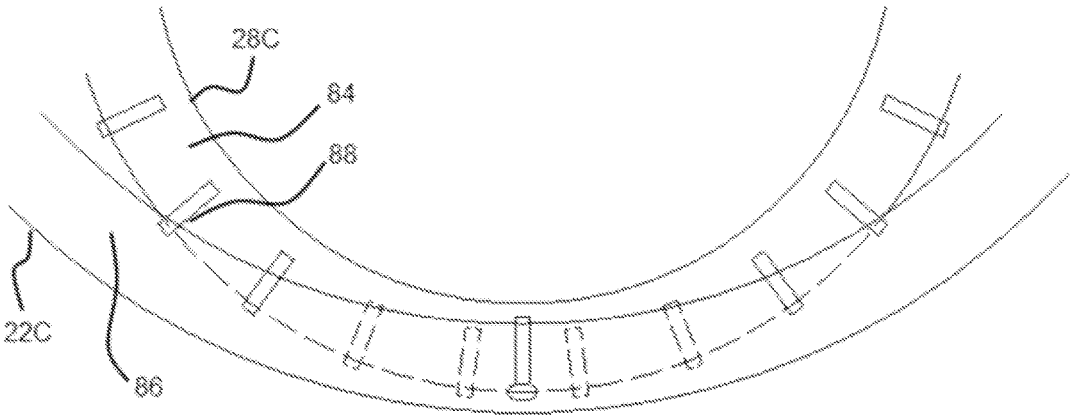
FIG. 13 is a side detail view of an embodiment of an anvil ring and hammer ring with circumferential ridges and grooves.
Figure 14:
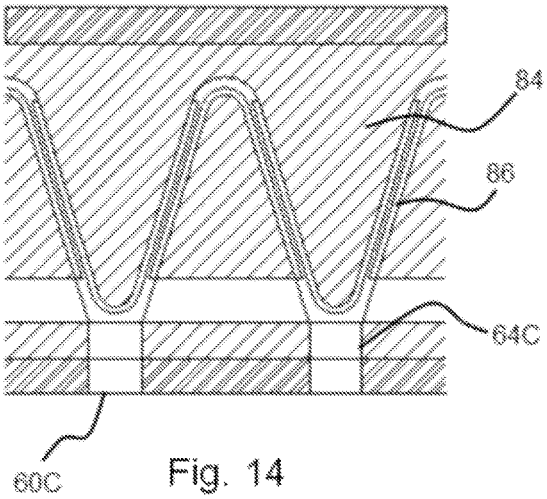
FIG. 14 is a side detail view of an embodiment of an anvil ring and hammer ring with circumferential ridges and grooves.
Figure 15:
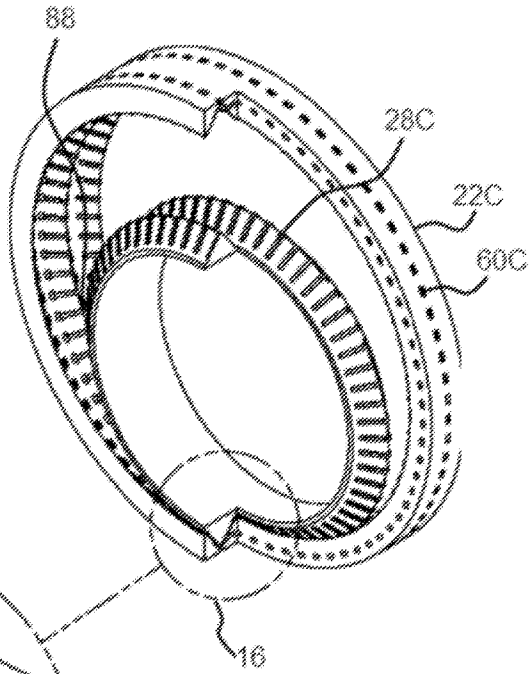
FIG. 15 is a perspective view of an embodiment of an anvil ring and hammer ring with circumferential ridges and grooves.
Figure 16:
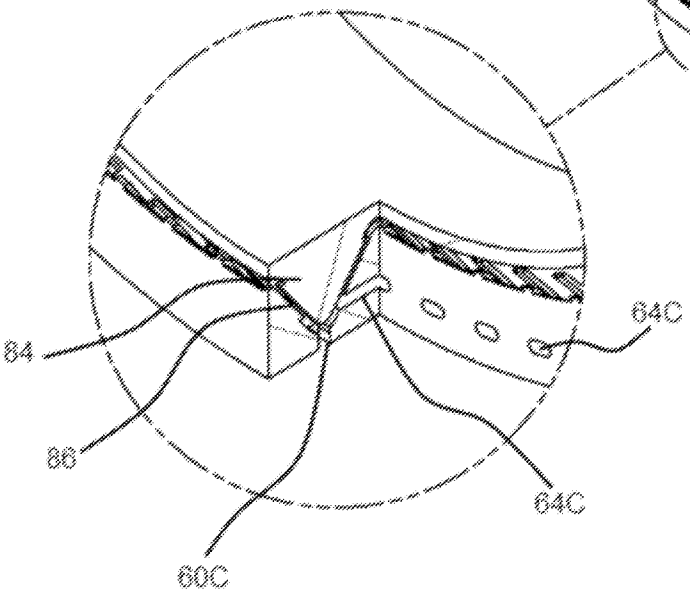
FIG. 16 is a detail view of the region 16 of FIG. 15

In some embodiments, the pocket wall surfaces 62 of the anvil pocket 36 assist in breaking the rock 38 as the pockets progressively nest with the protruding elements 32 (see FIG. 5) as the hammer ring 28 is rotated by an external drive (motor 44). As it is unlikely that the rock conforms to the pocket wall surfaces; the rock will likely bridge from one surface to another in a two, three, or more point contact resulting in shear fracture of the rock. As the protruding element 32 contacts the rock, the rock will tend to fracture and break.

Figure 22:
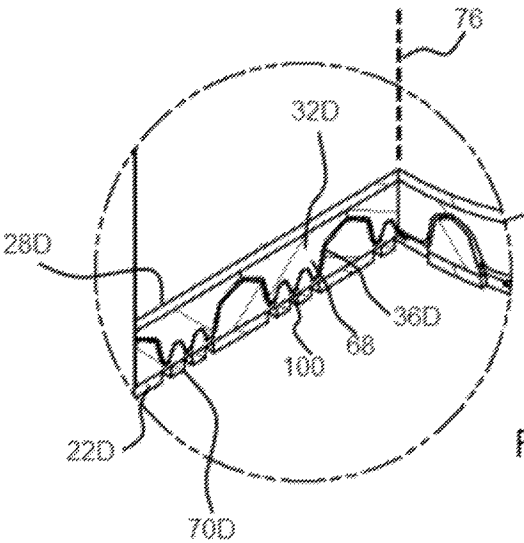
FIG. 22 is a detail view of the region 22 of FIG. 21

In one example, the hammer ring 28D includes protruding elements 32D which may further include multiple protruding fingers 68 as shown in FIG. 22 that individually nest within corresponding sockets 100 within each pocket 36D. The protruding element and pocket nesting action aids in comminuting all rocks, with the many fingers that interleave with the grate partitions, as rock is compressed and is forced through the grate openings 70D in the anvil ring 22D. The hammer ring 28D mass (weight) aids in rock breakage by increasing the rock breaking force, as the gaps 72 (see FIG. 3) between anvil ring 22 and hammer ring 28 close during rotation. Thereby reducing the forces exerted upon the hammer ring shaft, and shaft support bearings.

The hammer ring 28 in one form is preferably positioned by one or both of a hydraulic cylinder 46 and/or a mechanical adjustment device to achieve the necessary gap 72 between anvil pocket 36, wall surfaces 62, and grates 60; and the hammer ring protrusions 32/hammer valleys 74. One preferable position is achieved when broken rock surface area is maximized for a given power to drive the anvil ring 22 and hammer ring 28. Rock 38 is contained by the moving anvil ring 22 and a stationary shield 40 which has the feed chute 58 passing through its upper sealing zone. In some embodiments, the anvil ring 22 may also have a sealing zone which is positioned outside of the stationary shield 40. Together the shields withhold the rock comminution from escaping the mill 20 at undesired positions.

FIGS. 3-6 are cross-sectional views of embodiments of a CAHM with a plurality of equalizing ports 64A between laterally adjacent pockets 36A.

Figure 8:
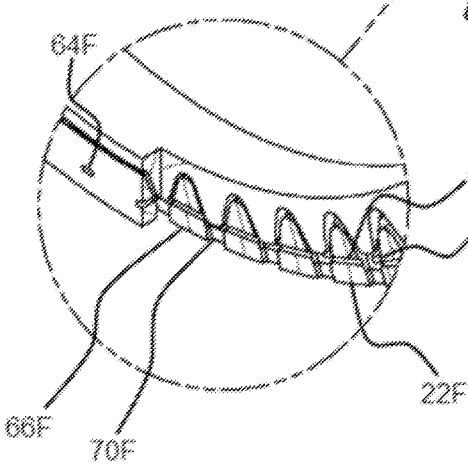
FIG. 8 is a detail view of the region 8 of the embodiment shown in FIG. 7.

FIGS. 5-8 illustrate another embodiment with lateral equalizing ports 64F running through the outer surface of the anvil ring 22F to evacuate matter crushed between the rings to equalize rock volume between laterally adjacent pockets. Circumferential equalizing ports 65F are also disclosed, extending between circumferentially adjacent pockets 36F. In this way, if more rock is comminuted in one pocket than the adjacent pocket, smaller particles of the rock are transferred laterally, or circumferentially to an adjacent pocket. Equalizing ports may be used between adjacent pockets for any adjacent pockets, if the ports are laterally arranged, sequentially arranged around the circumference of a ring, etc. Additionally, the equalizing pockets may be used in embodiments with openings (grates 60F) on the external surface of the anvil ring to evacuate crushed matter, and with anvil rings that do not have openings to evacuate crushed matter, etc. FIG. 8 illustrates a close up of an anvil ring 22F having equalizing channels 64A as well as holes 70F through the outer surface 66F of the anvil ring 22F to evacuate crushed matter.

Figure 3:
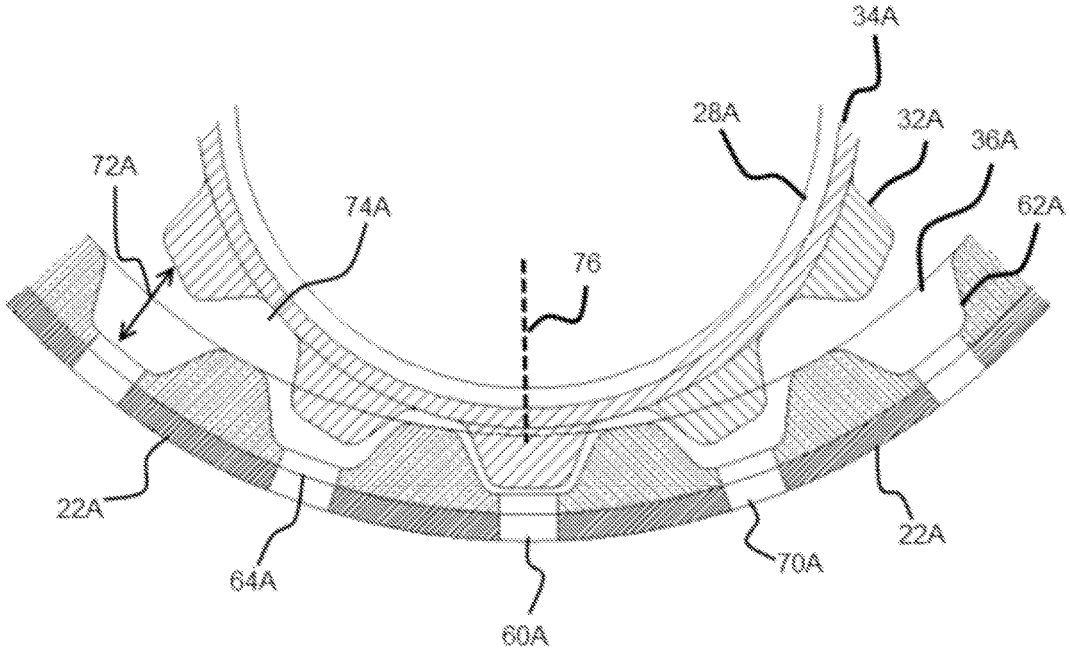
FIG. 3 is cross-sectional detail view of an embodiment of a conjugate anvil-hammer mill with a plurality of holes (ports or tunnels) from the pockets through the outer surface of the anvil ring.
Figure 4:
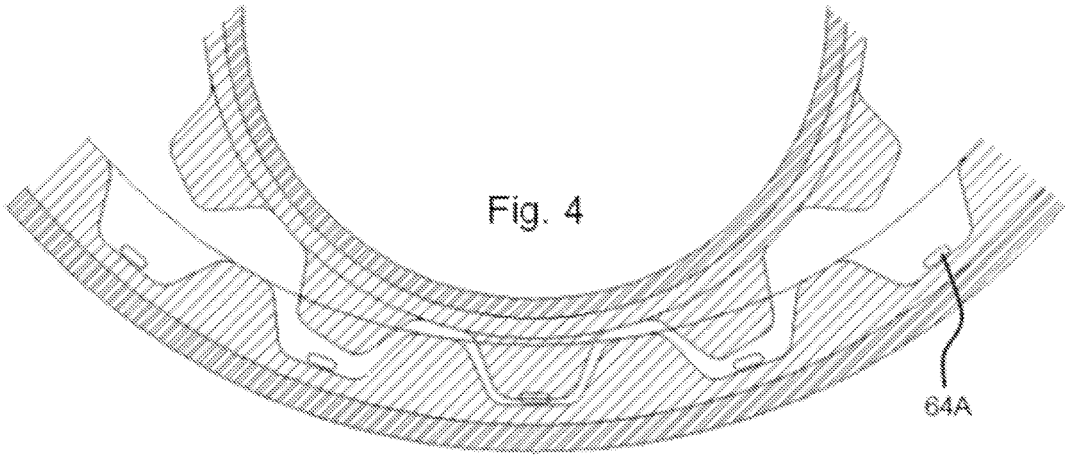
FIG. 4 is cross-sectional detail view of an embodiment of a conjugate anvil-hammer mill with a plurality of holes (ports or tunnels) between laterally adjacent pockets.
Figure 7:
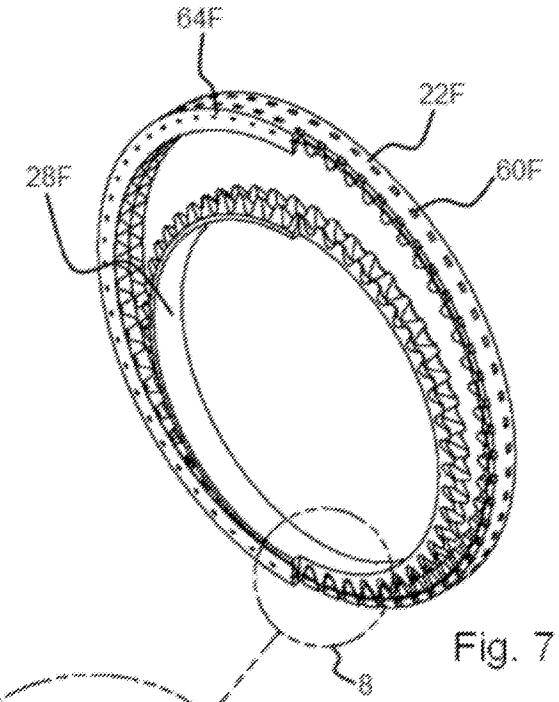
FIG. 7 is a perspective view of another embodiment of a hammer ring, and anvil ring.
Figure 20:
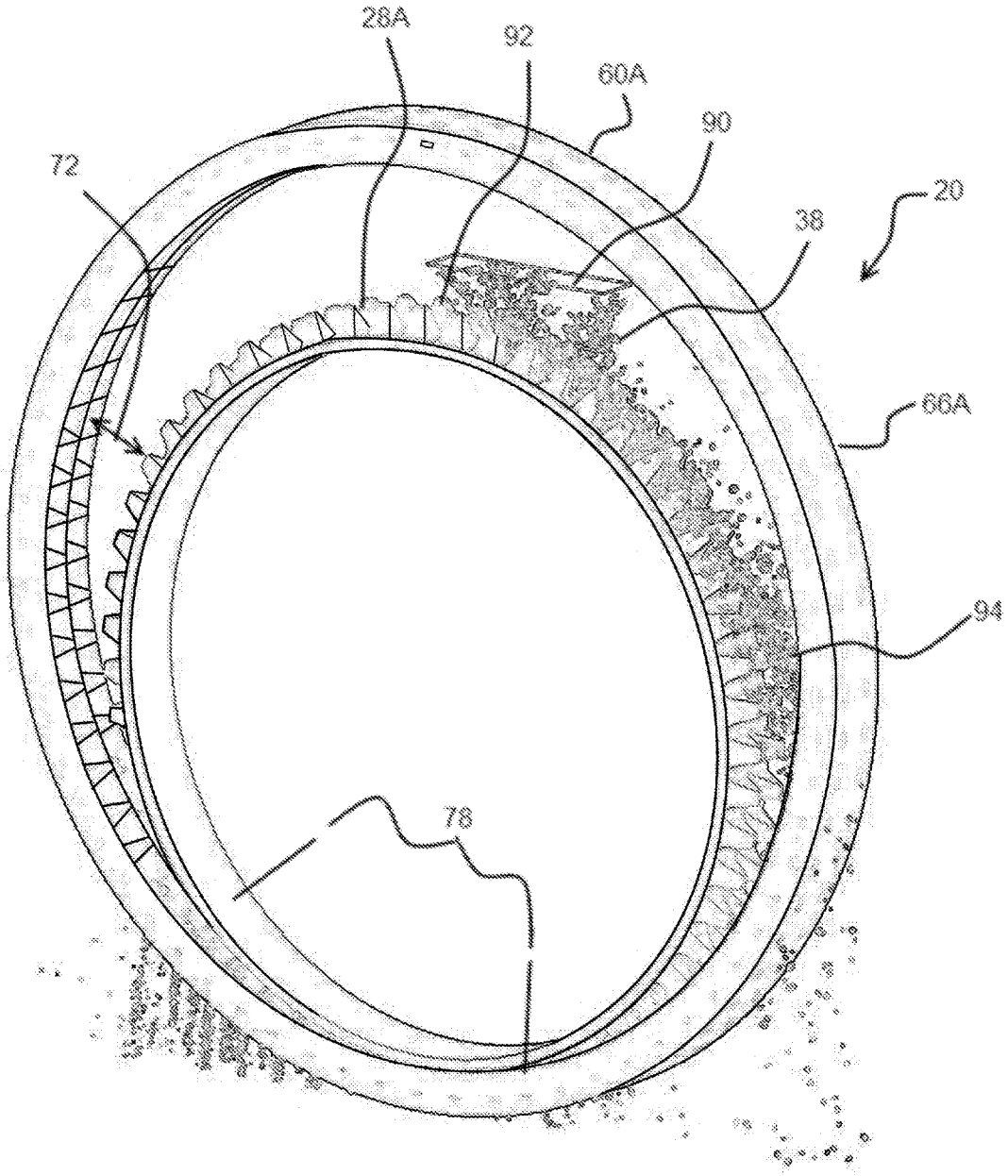
FIG. 20 is a perspective view of another embodiment of an anvil ring and hammer ring with wedge shaped protruding elements and pockets in use.

In some embodiments, once the material is crushed and rotates counterclockwise past a 6 o'clock position 76 (the 6 o'clock position being the position of minimum distance between the two rings as shown in FIG. 3), most of the material will exit the mill either through the openings 70A or though an opening in the shield 40. In these embodiments, retention of the comminuted matter will aid in crushing more of the remaining matter. In some embodiments, the crushed matter may be forced to exit when it reaches a 12 o'clock position, or before. Additionally, some embodiments allow material to re-enter the compression fracture zone 78 as shown in FIG. 20 to create a finer ground material. For example, one embodiment may involve grinding the material with successively finer grinding surface features between the rings (axially from one side of the ring to the other side, parallel to the shaft the ring spins on), whereby matter is fed from one end of the rings and discharge out the opposite end. For example, an embodiment may have multiple stages of coarse to fine grinding in the same machine, moving material dimensional geometries from large anvil-hammer, to fine pin mesh as rock axial motion is utilized by trapping comminuted material as it rotates up the outer ring wall or by tilting the machine slightly on is rotating axis.

In another embodiment, the CAHM can also be built to form briquettes as are used in iron ore or other briquetting machines. Instead of pins (protruding elements or pistons) and pockets, the material is filled in dual opposing pockets as it rotates into the high compression zone. In a briquetting embodiment, there may be pockets on either ring and when the rings mate in the high compression zone that the dual pockets form one pocket and make a briquette out of the comminuted fine feed stock and as a separate embodiment discharging matter. A gearing system or other apparatus may be needed to properly align pockets on the anvil ring and hammer ring.

FIGS. 9-12 show a an embodiment of an anvil and hammer mill with anvil pins 80 on the anvil ring 22B, and hammer pins 82 on the hammer ring 82B. The embodiment shown in FIG. 10 includes surface protrusions, pins 80/82, on both the hammer ring 28B and anvil ring 22B. The cross-section view in the middle of FIG. 3 shows the pins in an interlocking arrangement.

Figure 18:
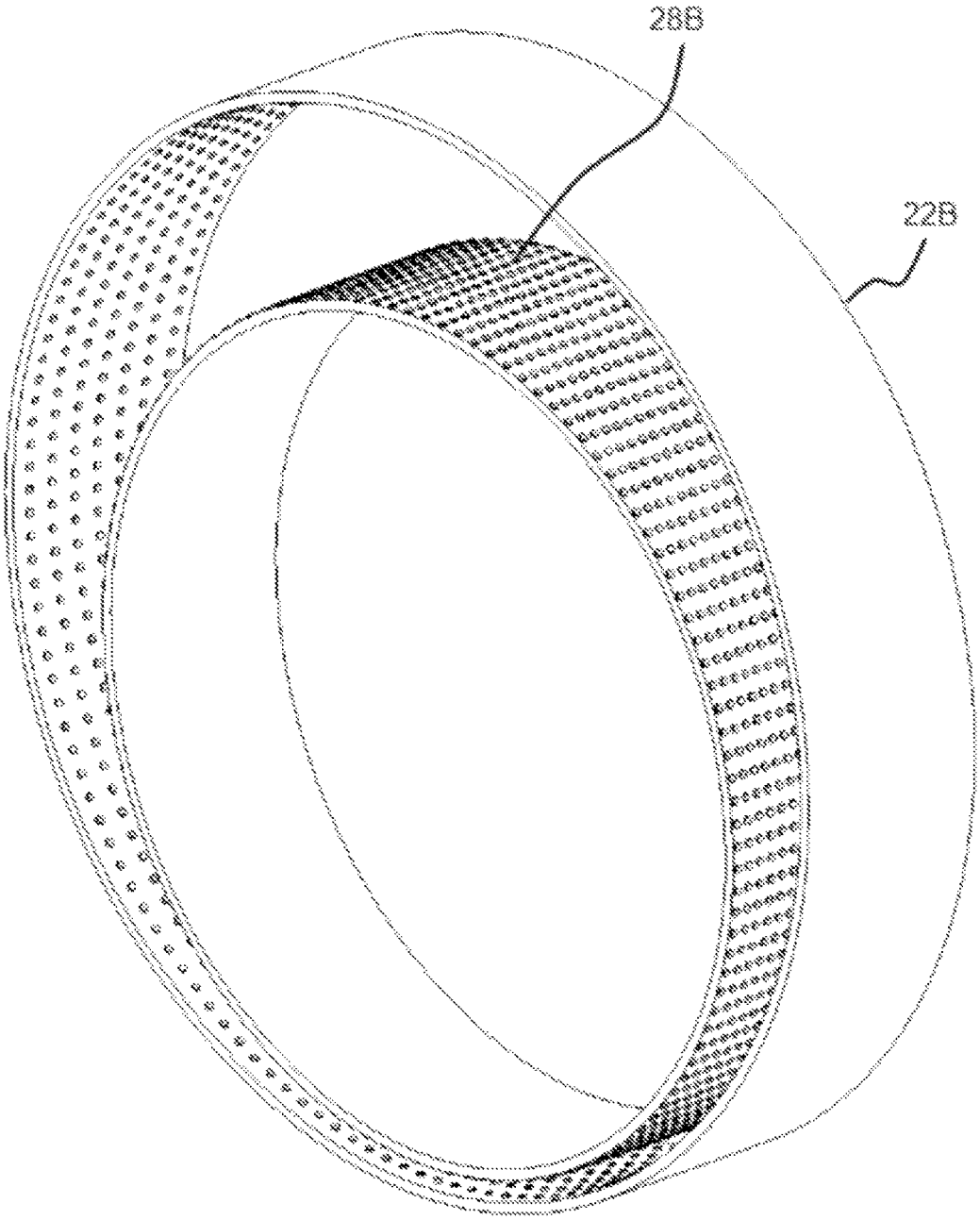
FIG. 18 is a perspective view of another embodiment of an anvil ring and hammer ring with protruding elements on both the anvil ring and hammer ring.

Other embodiments may have different offsets between the pins 80/82, different geometries of pins on either ring, etc. FIG. 18 depicts an embodiment of an anvil ring 22B and hammer ring 28B with pins as previously shown in FIG. 3.

In some embodiments, the anvil ring 22B and hammer ring 28B may both be mechanically driven. For example, the hammer ring 28B may rotate about an axle that is driven by a motor or other power source, and the anvil ring 22B may rest on a ring and pinion gear system that drives the outer ring by the same motor or engine as the hammer ring 28B, or may be driven by a separate motor or engine. Other dual drive embodiments may be utilized to rotate the rings at synchronized speeds or at differential speeds in relation to each other.

Figure 19:
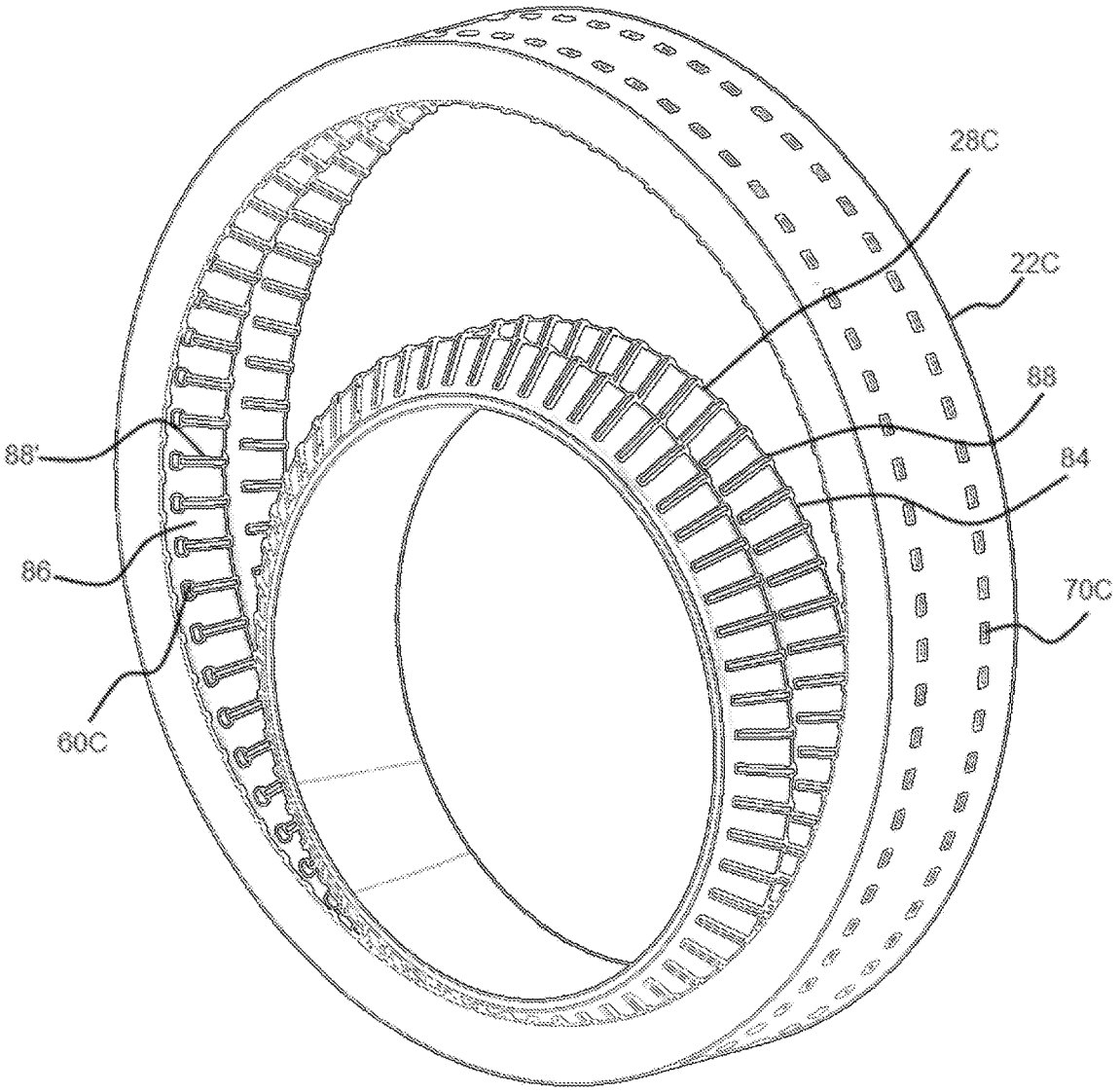
FIG. 19 is a perspective view of another embodiment of an anvil ring and hammer ring with circumferential ridges and grooves.

FIGS. 13-16 illustrate an embodiment of a CAHM with circumferential ridges 84 and grooves 86. This embodiment illustrates a ring construction that may drive the anvil ring 22C and the hammer ring 28C at differential speeds in relation to each other. The differential speeds add shear forces to the compression forces exerted upon rock being commuted. In some embodiments, one or both of the inner and outer rings may have blades 88 on the ridges 84 and/or grooves 86 to increase surface contour to better grip and retain rock entering the compression zone. In this embodiment, the blades 88 may also impart shear stresses due to differential speeds between the rings 22C/28C. FIG. 19 is a larger view of an embodiment of a CAHM with circumferential ridges 84 and grooves 86 as previously shown in FIGS. 13-16. FIG. 19 also shows blades 88' upon the grooves 68, although a detent may alternatively be used to direct material into the exit grate 60C and cooperate with the blades 88. This embodiment may use groove clearing "plows" to remove undesired material from the grooves, and may dispose this material into a removal chute (not shown).

Figure 17:
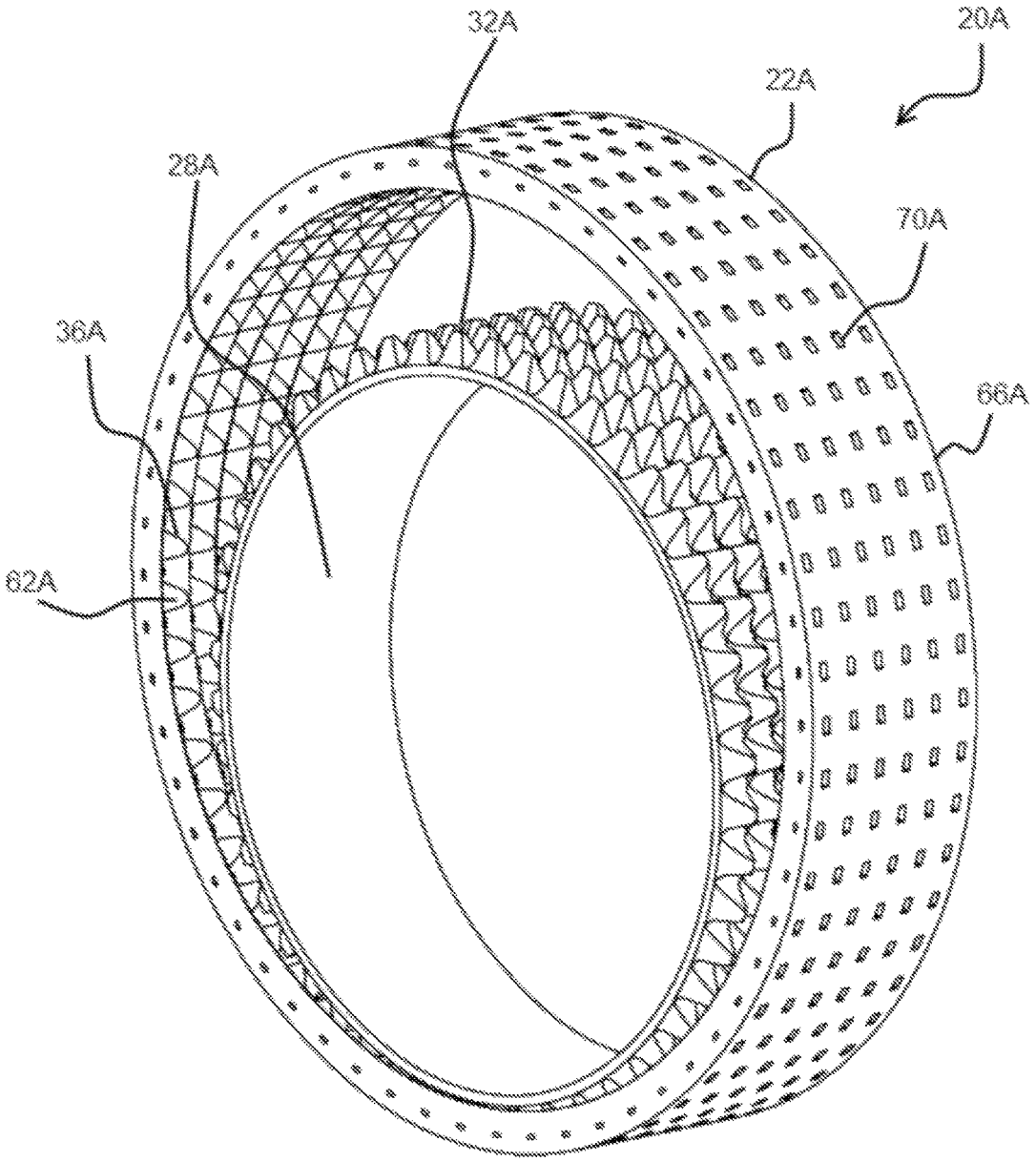
FIG. 17 is a perspective view of another embodiment of an anvil ring and hammer ring with wedge shaped protruding elements and pockets.

FIG. 17 shows an embodiment of the ring portions of a CAHM 20A as previously shown in FIGS. 3-8 with protrusions 32A on the hammer ring 28A and pockets 36A on the anvil ring 22A. Other embodiments may have these components reversed, may have protrusions 32 on both rings, may have intersecting pockets 36 of both rings (to briquette crushed material), may have rings and grooves, or other surface geometries may be used that aid in crushing or compacting material. Holes 70A are shown through the outer surface 66A of the anvil ring 22A. These holes 70A may align with the pockets 36A on the inner surface 62A of the anvil ring 22A and may be used to evacuate material that is crushed to the dimension of the holes 70A or smaller.

In some embodiments, the protrusions 32 on the hammer ring 28 may be independently and individually fastened to the hammer ring 28, or may be attached to the ring in groups, such as rows, pairs, triplets, etc. These protrusion sets may be fastened by a shear key and a locking device on one or both of the ends of the protrusions or groups of protrusions. For example, the protrusions may be in a set of rows, mounted axially across the surface of the inner ring in relation to the shaft through the ring and each row may have a shear key that fits into a groove in the surface of the ring to support the keys while allowing relatively simple installation or replacement (in comparison to protrusions that are bolted to the hammer ring).

Figure 23:
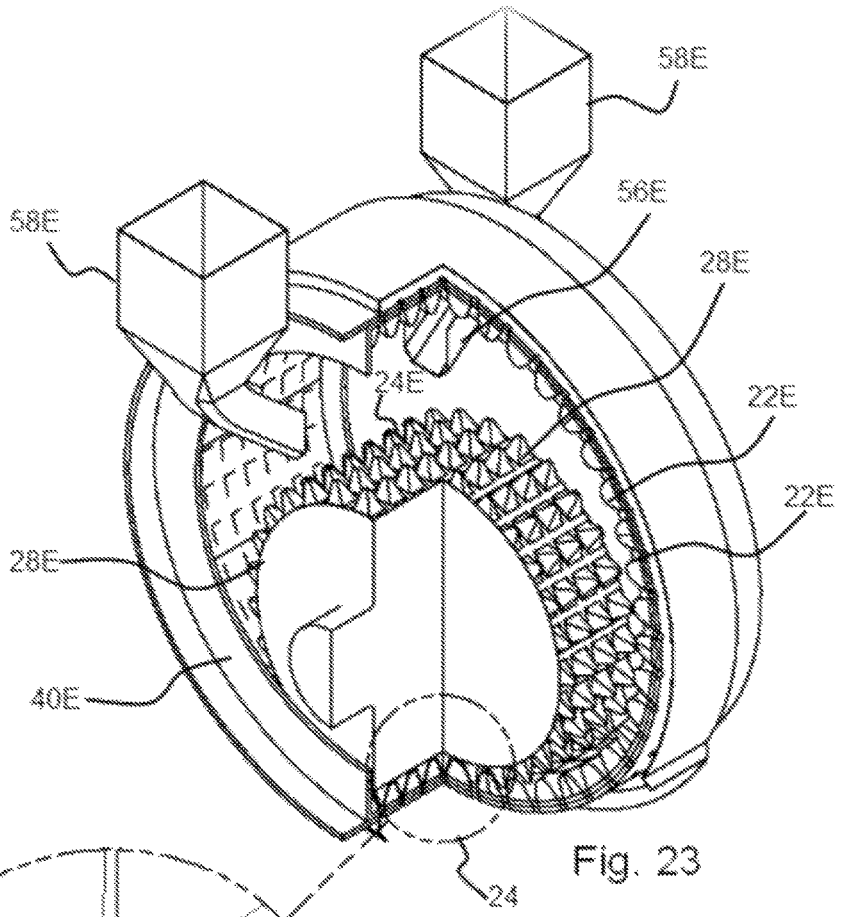
FIG. 23 is a perspective cutaway view of another embodiment of an anvil ring and hammer ring with wedge shaped protruding elements and pockets.
Figure 24:
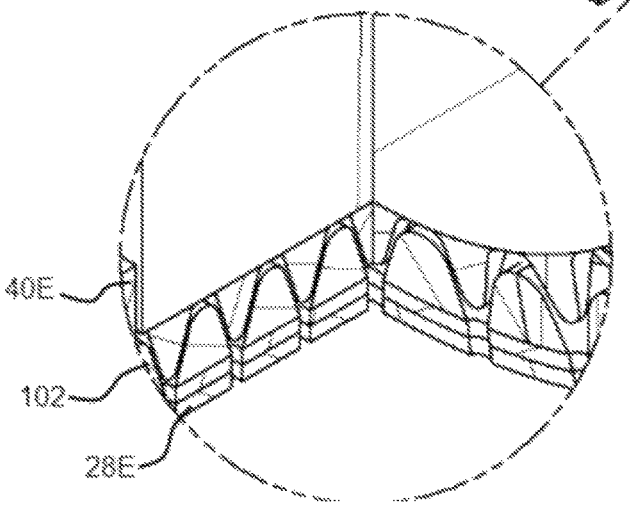
FIG. 24 is a detail view of the region 24 of FIG. 23.
Figure 25:
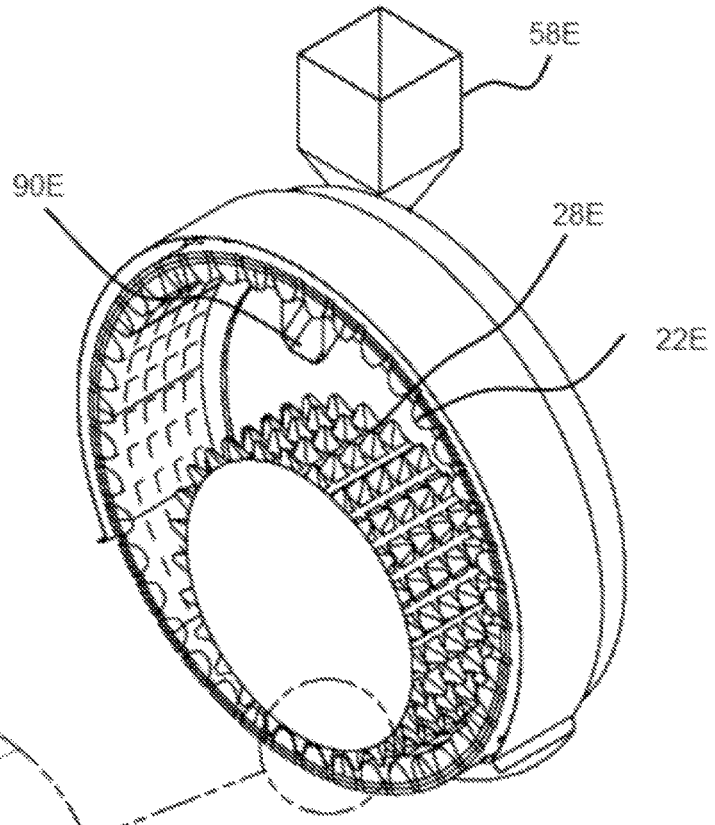
FIG. 25 is another cutaway view of the embodiment of FIG. 23.
Figure 26:
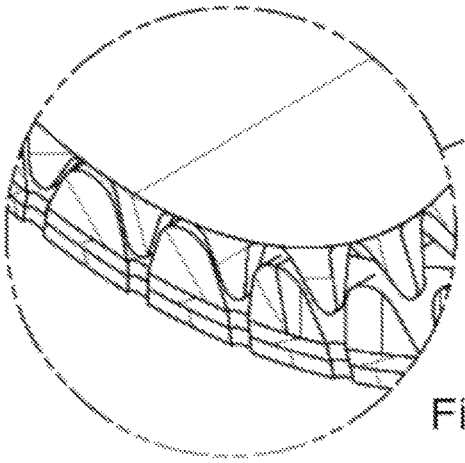
FIG. 26 is a detail view of the region 26 of FIG. 25.
Figure 27:
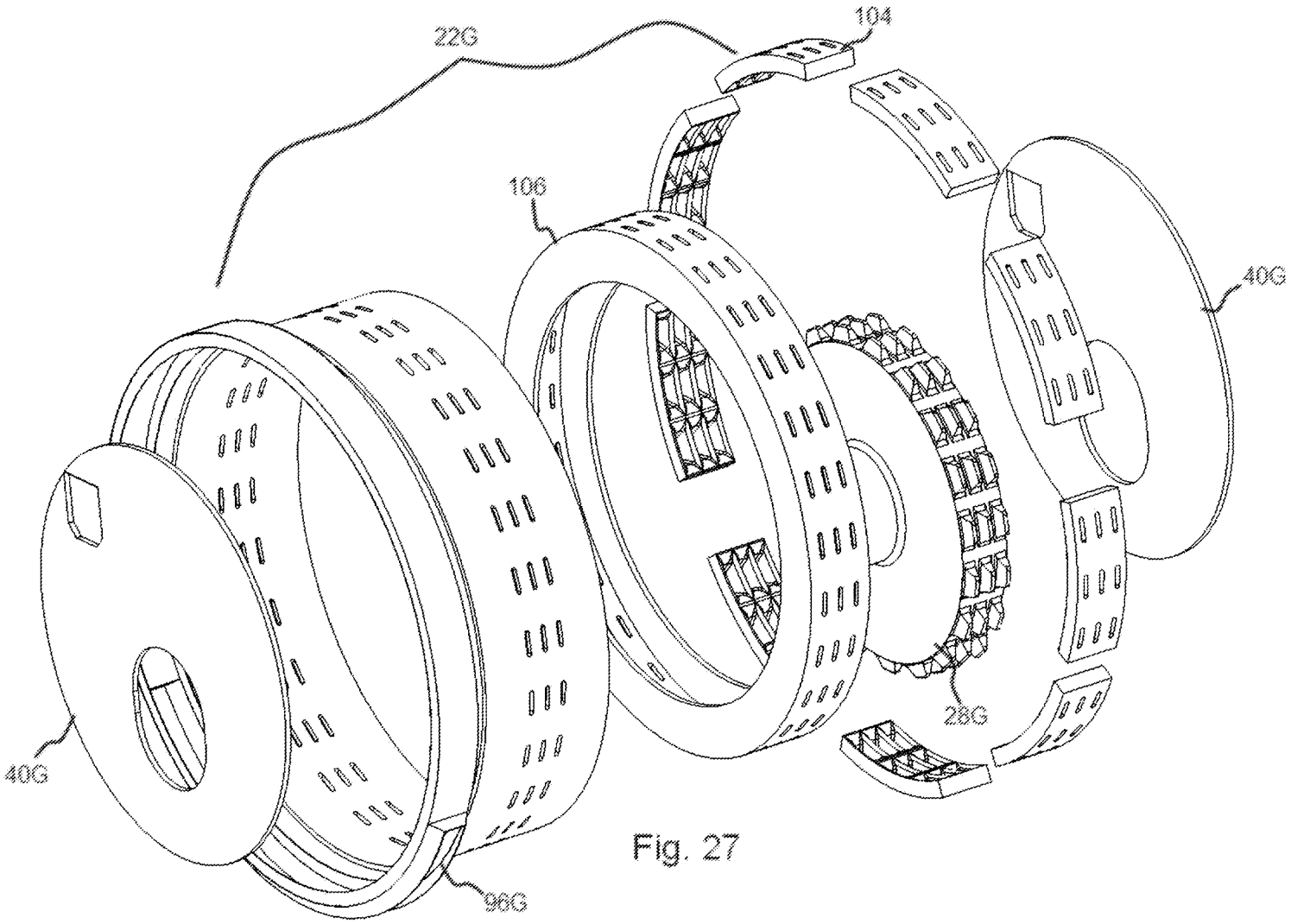
FIG. 27 is an exploded view of an embodiment wherein the pockets are formed as replaceable sub-components.
Figure 28:
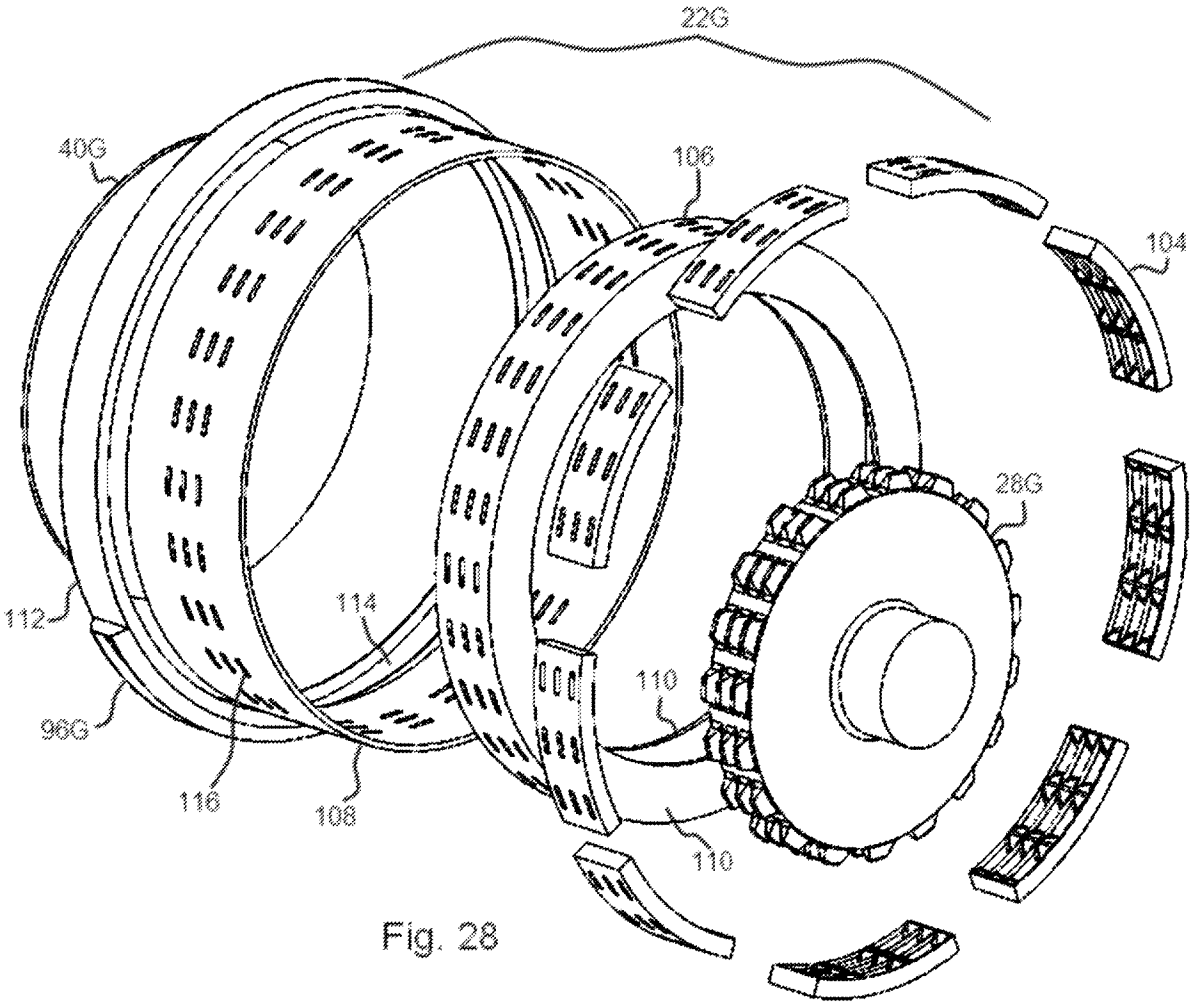
FIG. 28 is an exploded view of an embodiment wherein the pockets are formed as replaceable sub-components.

Further, the surface castings 104 on the anvil ring (that create pockets) may be provided in groups as shown in FIGS. 27 and 28 and may be held by an arch construction, or other fastening system, to hold the surface castings 104 in place upon an inner channeled ring 106 which engages an outer ring 108 wherein the rings are not in contact and the surface castings 104 in the inner ring 106 are "hanging" from the inside of the ring 106. In one form, the laterally outward sides 110 of the inner ring 106 serve the same function as the flanges 40E of FIGS. 23 and 24 described below to keep material from prematurely exiting the mill or jamming the mechanism. Additionally, flanges 40G may also be provided which may be attached to a seal 112 which also provides an exit port 96G for commutated material. The seal 112 may further include a channel 114 which surrounds the ports 116 in the outer ring 108 such that material which passes there through is directed towards the exit port 96G. In one form, the outer ring 108, inner ring 106, and surface castings 104 rotate together within the seal 112 which is static. Thus, the support bearings may rest on the outer ring 108 on either side of the seal 112. The present embodiments are examples however, and some embodiments may use other arrangements and fastening systems for the surface portions of either ring than those of the present example.

FIG. 20 is an elevated view of a portion of an embodiment of a CAHM illustrating material 38 (rock) being crushed in the mill 20. In this figure, the chute opening 90 near the top 92 of the hammer ring 28A is the location where rock may be fed into the mill 20, for example through a feed chute 58 as shown in FIG. 2. In some embodiments, the feed chute 58 may direct the material to be crushed by a specified angle and means of uniformly distributing feed matter into each pocket. The material 38 may then reposition toward the compression zone 78 and as the rings rotate, the material is compressed between the rings as the gap 72 between the rings decreases linearly into the compression zone 78. This linear compression creates a slower compression than the rate of prior art high pressure grinding roll (HPGR) mills, which utilizes the external surface of two rotating cylinders. As depicted in the embodiment of FIG. 8, matter that is smaller than the exit grates 60F (and openings 70F) through the external surface 66F of the hammer ring 28F can pass through the ring, or may not be ejected. Non-ejected rock 94 may make another pass around the apparatus, back to the compression fracture zone 78 where it will eventually be ejected.

In one embodiment as shown in FIG. 1, the shield 40 may include an open region such that the rock which does not pass through the ring, may be ejected through an ejection port 96 along a direction of flow 98.

Figure 21:
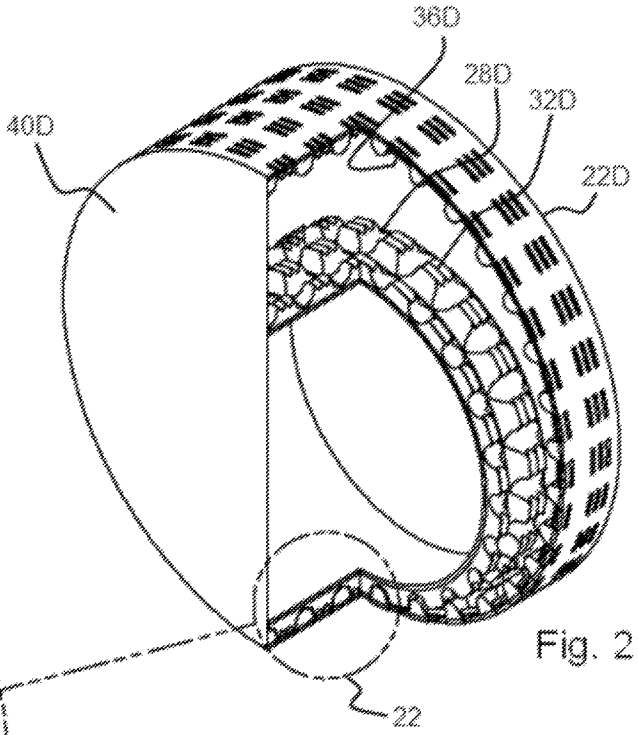
FIG. 21 is a double cross-section view of one embodiment of an anvil ring and hammer ring with protrusions, pockets with fingers thereon.

FIG. 21 is a double cross-section view of one embodiment of a CAHM with protrusions 32D and pockets 36D. In this embodiment, a cross section is shown across the axis of inner and outer ring when the system is at the closest point. This cross section illustrates protrusions 32D with fingers 68; and pockets 36D with sockets 100 which coordinate with the fingers 68. These fingers 68 and sockets 100 may be of multiple sizes, to create different areas of breakage, to accommodate rocks of varying size and hardness. This structure also allows additional support points. For example, when a rock is placed in a pocket 36D in the anvil ring 22D, the hammer ring 28D rotates therewith, and all rock or material in each pocket will be broken down into the size of the smallest gap 72 between the rings. In this embodiment, the different sizes of surface structures and different gap sizes may improve efficiency in some applications. In some embodiments, there may be a substantially consistent gap 72 between teeth and pockets at the 6 o'clock position 76.

Additionally, the holes 70 in the grates of the outer ring may be sized according to the degree of crushing desired. For example, if it is desired that the largest resultant crushed rock have a maximum diameter of 50 mm then the grates of the apparatus would have an inner diameter (width/length) of 50 mm. Additionally, the holes may have different dimensions in other directions, for example, a hole may have a 50 mm width and a 150 mm length, where the length may be in the direction circumferentially around the inner surface of the outer ring. The gap size in the hole may also be selected to reduce power consumption (as there is a pronounced increase in power consumption for a relatively small percentage change in gap size).

One significant disadvantage of prior art high pressure grinding roll (HPGR) and other crushing mills is that material would often jam between the shield and one or both rollers. In many prior art applications, the shield is static, and does not rotate with either roller, further causing material to jam between the shield and the roller. This problem has been at least partially alleviated herein a shown in FIG. 24 where the shield 40E is attached to the hammer ring 28E either permanently or removably and rotates therewith. Thus, the shield 40E will generally hold material 38 within the chamber 24E, and any material that would lie against the shield 40E in the compression zone, will tend toward the first pocket row 102 adjacent the shield 40F and be compressed therein. Another shield may be used between the later outer sides of the hammer ring, and the lateral inner sides of the anvil shield 40E when desired.

While the present disclosure is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The disclosed apparatus and method in their broader aspects are therefore not limited to the specific details, representative apparatus and methods, and illustrative examples shown and described. Accordingly, departures may be made from such details without departing from the spirit or scope of applicants' general concept.

Therefore I claim:

1. A conjugate anvil-hammer mill comprising:

a. an anvil ring comprising a substantially cylindrical structure having an inner surface which defines a chamber wherein the anvil ring rotates about a horizontal longitudinal center anvil ring axis;

b. a hammer ring located within the anvil ring which rotates in the same direction as the anvil ring;

c. the hammer ring comprising a substantially cylindrical structure having an outer surface;

d. wherein the hammer ring is mounted to a horizontal driven shaft to rotate about a longitudinal center hammer ring axis offset from and parallel to the longitudinal center anvil ring axis;

e. a force member coupled between the horizontal driven shaft of the hammer ring and the anvil ring to provide a linear rate of compression force therebetween;

f. the hammer ring having a plurality of laterally adjacent protruding elements attached to the outer surface of the hammer ring; and g. wherein rock material may be inserted into the chamber and crushed between the anvil ring and the hammer ring with a linear rate of compression.

2. The conjugate anvil-hammer mill as recited in claim 1 wherein the protruding elements are removably attached to the hammer ring.

3. The conjugate anvil-hammer mill as recited in claim 2 wherein the protruding elements are provided in groups.

4. The conjugate anvil-hammer mill as recited in claim 1 wherein:

a. the hammer ring is fixedly coupled to a laterally aligned central axle;

b. the central axle is supported on each side of the hammer ring by bearings; and c. the central axle is driven by a mechanical motor.

5. The conjugate anvil-hammer mill as recited in claim 1 further comprising surfaces defining anvil exit grates extending from the most radially outward portion of each pocket through the anvil ring to allow crushed material to pass radially outward there though.

6. The conjugate anvil-hammer mill as recited in claim 1 wherein the outer diameter of the hammer ring is at least 50% of the inner diameter of the anvil ring.

7. The conjugate anvil-hammer mill as recited in claim 1 wherein the hammer ring contains water for additional weight.

8. The conjugate anvil-hammer mill as recited in claim 1 further comprising surfaces defining lateral equalizing ports extending between laterally adjacent pockets.

9. The conjugate anvil-hammer mill as recited in claim 1 further comprising surfaces defining circumferential equalizing ports extending between circumferentially adjacent pockets.

10. The conjugate anvil-hammer mill as recited in claim 9 further comprising surfaces defining lateral equalizing ports extending between laterally adjacent pockets.

11. The conjugate anvil-hammer mill as recited in claim 1 wherein the protruding elements comprise rings extending circumferentially around the outer surface of the hammer ring.

12. The conjugate anvil-hammer mill as recited in claim 11 wherein the rings comprise blades extending therefrom.

13. The conjugate anvil-hammer mill as recited in claim 11 wherein the anvil ring and hammer ring rotate at differential speeds.

14. The conjugate anvil-hammer mill as recited in claim 1 further comprising a ring-shaped shield attached laterally outward portion of the hammer ring and configured to rotate therewith.

15. The conjugate anvil-hammer mill as recited in claim 1 wherein the force member is a hydraulic mechanism providing the linear rate of compression between the anvil ring and the hammer ring.

16. A conjugate anvil-hammer mill comprising:

a. an anvil ring comprising a substantially cylindrical structure having an inner surface which defines a chamber wherein the anvil ring rotates about a horizontal longitudinal center anvil ring axis;

b. a hammer ring located within the anvil ring which rotates in the same direction as the anvil ring;

c. the hammer ring comprising a substantially cylindrical structure having an outer surface;

d. wherein the hammer ring is mounted to a horizontal driven shaft to rotate about a longitudinal center hammer ring axis offset from and parallel to the longitudinal center anvil ring axis;

e. a force member coupled between the horizontal driven shaft of the hammer ring and the anvil ring to provide a linear rate of compression force therebetween;

f. the hammer ring having a plurality of laterally adjacent protruding elements attached to the outer surface of the hammer ring;

g. wherein rock material may be inserted into the chamber and crushed between the anvil ring and the hammer ring with a linear rate of compression; and h. wherein the anvil ring comprises a plurality of pockets on the inner surface thereof wherein each of the protruding elements is configured to sequentially engage into one of the pockets of the anvil ring between lateral and circumferential surfaces of the pockets as the hammer ring and anvil ring rotate.

17. The conjugate anvil-hammer mill as recited in claim 16 wherein the pockets are removably attached to the anvil ring.

18. The conjugate anvil-hammer mill as recited in claim 17 wherein the pockets are provided in groups.

19. The conjugate anvil-hammer mill as recited in claim 16 wherein at least some of the protruding elements further comprise fingers thereupon.

20. The conjugate anvil-hammer mill as recited in claim 19 wherein at least some of the pockets further comprise sockets which interoperate with the fingers of the associated protruding elements.

* * * * *